US005785804A

United States Patent [19]

Kovacs et al.

[11] Patent Number: 5,785,804

[45] Date of Patent: Jul. 28, 1998

[54] BAG GRIPPING AND TRANSFER APPARATUS AND METHOD

[75] Inventors: Lloyd Kovacs, Sheboygan, Wis.; Larence Calvin Dobbs, Greer, Calif.

[73] Assignee: Hayssen, Duncan, S.C.

[21] Appl. No.: 799,498

[22] Filed: Feb. 12, 1997

Related U.S. Application Data

[60] Continuation-in-part of Ser. No. 550,580, Oct. 31, 1995, abandoned, which is a division of Ser. No. 242,735, May 13, 1994, Pat. No. 5,536,357.

[51] Int. Cl.[6] ..... B65C 9/00

[52] U.S. Cl. ..... 156/556; 156/443; 156/216; 156/492; 156/570

[58] Field of Search ..... 156/556, 566, 156/569, 572, 515, 443, 447.1, 478–480, 483, DIG. 1, DIG. 42, 492, 538, 570, 216, 475; 53/450, 451, 455, 477, 552, 562, 136.5, 138.3; 198/470.1, 728, 377; 493/189, 193, 194, 209, 227

[56] References Cited

U.S. PATENT DOCUMENTS

| | | | |
|---|---|---|---|
| 4,517,790 | 5/1985 | Kreager | 156/515 X |
| 4,538,161 | 8/1985 | Reist | 226/11 X |
| 4,561,923 | 12/1985 | DeLorenzi et al. | 156/475 X |
| 4,571,236 | 2/1986 | Adams | 198/470.1 X |
| 5,031,380 | 7/1991 | Ueda | 53/552 X |
| 5,213,198 | 5/1993 | Kovacs | 198/728 |

*Primary Examiner*—James Engel

*Attorney, Agent, or Firm*—Lee, Mann, Smith, McWilliams, Sweeney & Ohlson

[57] ABSTRACT

A method and apparatus for application of a header label to the bag. The bag, which has previously been filled with a product, is presented to the apparatus at an upstream bag presentation and accepting station and is gripped proximate its top. It is then transferred from the upstream bag accepting station to a downstream bag release station. Before being released, the bag travels to an intermediate label application station where a label is readied and applied to the bag. Thereafter, the bag proceeds downstream, with the label, and the label is sealed to the bag. A series of grippers are employed for accepting a stream of discreet bags in a continuous manner. The grippers are recirculated continuously so that the apparatus operates continuously so long as bags are presented for application of a label.

18 Claims, 14 Drawing Sheets

BAG GRIPPING AND TRANSFER APPARATUS AND METHOD

RELATED APPLICATION

This application is a continuation-in-part of U.S. patent application Ser. No. 08/550,580 now abandoned, filed Oct. 31, 1995 which is a division of U.S. patent application Ser. No. 08/242,735, filed May 13, 1994, now U.S. Pat. No. 5,536,357.

BACKGROUND OF THE INVENTION

This invention relates to vertical form, fill and seal machines, and more particularly to a method and apparatus for applying a header label to a bag, particularly but not limited to after the bag has been filled by a vertical form, fill and seal machine.

When bags are formed by a vertical form, fill and seal machine, the bags are filled with a product and ready for further handling, such as packaging in a carton or downstream processing. If downstream processing is desired by a machine, it is important that the bag leave the vertical form, fill and seal machine under control, that is, held in proper alignment for its downstream processing. However, since the vertical form, fill and seal machine is also continuously forming bags in series, formed bags must also be moved out of the path of an oncoming bag as that bag is being formed in order to not interfere with the bag and therefore slow the operating speed of the vertical form, fill and seal machine.

For many years, labels, typically pre-printed paper labels, have been applied to the top of bags, originally as an inexpensive way of identifying the manufacturer and the contents of the bag, without having to print on the bag itself. This system used to be particularly important to manufacturers who had many different products, many of which could be packaged in the same size bag.

The cost of having printed bags for each different product was prohibitive, but it was relatively inexpensive to buy plain, unprinted bags and have small quantities of labels separately printed for various products. The labels, either being plain or heat seal coated, and the cost of sheet printing and cutting to size for the labels are relatively modest in relation to printing of different bags for different products.

The first machines for applying labels to bags were developed in the 1950's. These machines were semiautomatic, using clamping jaws to apply plain paper labels to bags. The operator typically placed the bag in a position adjacent to sealing jaws with a label in position, a folder blade folded the top of the bag and the label together, and the heated jaws were then closed on the bag under very high pressure. The combination of heat and pressure adhered the label to the bag top. Such machines were manufactured by the Doboy Company of New Richmond, Wis., U.S.A.

The rate of operation of these semiautomatic machines relied to a large degree on the dexterity of the machine operator. Rates of 20 to 25 bags per minute per operator are common, but given the required human interaction and stepwise functioning of the machine, much faster rates could not be obtained.

In order to increase productivity, continuous automatic machines where introduced in the late 1950's, also by Doboy Company. These machines operated at a rate of about 60 bags per minute, but because of their continuous motion, insufficient pressure could be generated to handle plain paper labels, and consequently more expensive heat seal coated label paper had to be used. An operator was still required to place the bag into the continuous motion infeed of the automatic machines. No means was provided for automatically gripping the bag and then introducing it into the continuously-moving machine.

Both semiautomatic and automatic machines, such as those described above, applied what is known in the industry as a "saddle label", a label that is folded so that a portion appears on both the front and rear of the bag. A saddle label can have equal portions on both the front and rear of the bag, or can be offset, usually to the front of the bag, so that a larger portion of the label appears on the bag front.

The Doboy machines also had the capability of punching a hole in the finished bag to enable the bag to be pegged or racked at a point of sale. The label also reinforced the strength of the bag in the area of the hole to prevent tearing when the bag is hung.

While such machines are faster than strictly manual application of a label to a bag, in the case of both semiautomatic and automatic machines, if the operator presents the bag to the machine in an out of square condition, the label is applied out of square to the bag, resulting in an unsightly bag. This result often occurs given the fact that an inexact human step is involved in both processes. Because of the repetitive nature of the operation, many prior processes include counter balance devices to reduce operator stress and fatigue, but speeds are still held to a maximum of approximately twenty bags per minute per human operator.

Attempts have been made to completely automate application of a label to a bag emanating from a vertical form, fill and seal machine. The most successful of these attempts has been to apply a label to the front of the bag only (not a saddle label) by tacking a heat seal label to the bag film in the area of the forming tube (before the bag is filled) so that as the forming tube is advanced, the label is stopped in the area of the sealing jaws, where it is heat sealed to the bag, a hole is punched, and the bag is severed just above the label. Such machines were made by Hayssen Manufacturing Company, Sheboygan, Wis., U.S.A. beginning in about the mid 1960's.

Another method of forming a sealed bag is to apply a "simulated header", where the packaging material is actually printed to look like a header, and the sealing system of the vertical form, fill and seal machine is enlarged to seal the complete area of the simulation of the label. In the case of polyethylene, a seal is made at the top of the simulated area and a secondary seal is made at the bottom of the simulated area. However, no label is actually applied to the bag.

The purpose of the present invention is to provide a method and apparatus, automatic from start to finish, for regularly and accurately applying saddle labels to bags in a fully automatic fashion.

SUMMARY OF THE INVENTION

The invention pertains to an apparatus for applying a header label to a bag, as well as the process for doing so. The apparatus according to the invention is for application of a header label to a bag. The apparatus includes a primary gripper for gripping and transporting a bag, and means for transferring the primary gripper through a plurality of stations where action is taken on the bag, one of the stations being a label application station. A secondary gripper is provided for gripping the bag at the label application station, and a supply of individual labels is oriented in a queue at the label application station. Means is provided for releasing the primary gripper after the secondary gripper grips the bag. Means at the label application station is provided for removing a label from the queue and applying the label to the bag when held by the secondary gripper. Means is also provided for reactivating the primary gripper to grip both the bag and the label, and deactivating the secondary gripper to release the bag.

In accordance with the preferred form of the invention, the supply of individual labels is located in a magazine. The magazine is oriented with the labels queued in a line lying a plane generally parallel to a path travelled by the primary gripper, but with the line being at an oblique angle to the travelled path.

The means for removing a label from the queue includes a transfer arm, with the transfer arm having a label handling head at one end. The label handling head includes means for holding and folding a label. In accordance with the preferred form of the invention, this latter means comprises a vacuum plate having a central hinge.

The transfer arm also includes means for linearly translating the label handling head. The linear translating means comprises an extensible piston, in the preferred form of the invention.

The transfer arm is rotatable about a horizontal pivot point in order to transfer the label from the queue to the top of the bag. The label handling head includes vacuum means for holding the label, and also includes means for sensing vacuum at the label handling head so that the absence of a label can be sensed and appropriate action taken due to that absence.

The method according to the invention comprises the steps of orienting a bag vertically at the label application station. Next, the secondary gripper is closed on the bag beneath the primary gripper, and the primary gripper is then released. At that time, a label is selected from the queue of labels located in the line above and in a plane generally parallel to the path travelled by the bag. The label is folded and transferred from the queue to a position straddling the top of the bag, where it is applied to the bag, the primary gripper is reactivated to grip both the bag and the label, and the secondary gripper is deactivated to release the bag for transfer to the sealing station.

During the step of removing the label from the queue, the method includes extending the label handling head to a position abutting the label, and activating the vacuum plate in the label handling head to remove the label from the queue. At this point, the vacuum in the vacuum plate is applied, and a signal is generated if a predetermined level of vacuum is not sensed.

Once the label has been removed and the vacuum established, the method includes rotating the label in an arc, and simultaneously performing folding of the label as it is rotated. Once the label has been applied to the top of the bag and the bag and the label are re-gripped by the primary gripper, the bag is preferably transferred downstream and then the label is sealed to the top of the bag.

BRIEF DESCRIPTION OF THE DRAWINGS

The invention is described in greater detail in the following description of an example embodying the best mode of the invention, taken in connection with the drawing figures, in which.

DESCRIPTION OF EXAMPLES EMBODYING THE BEST MODE OF THE INVENTION

Figure 1:
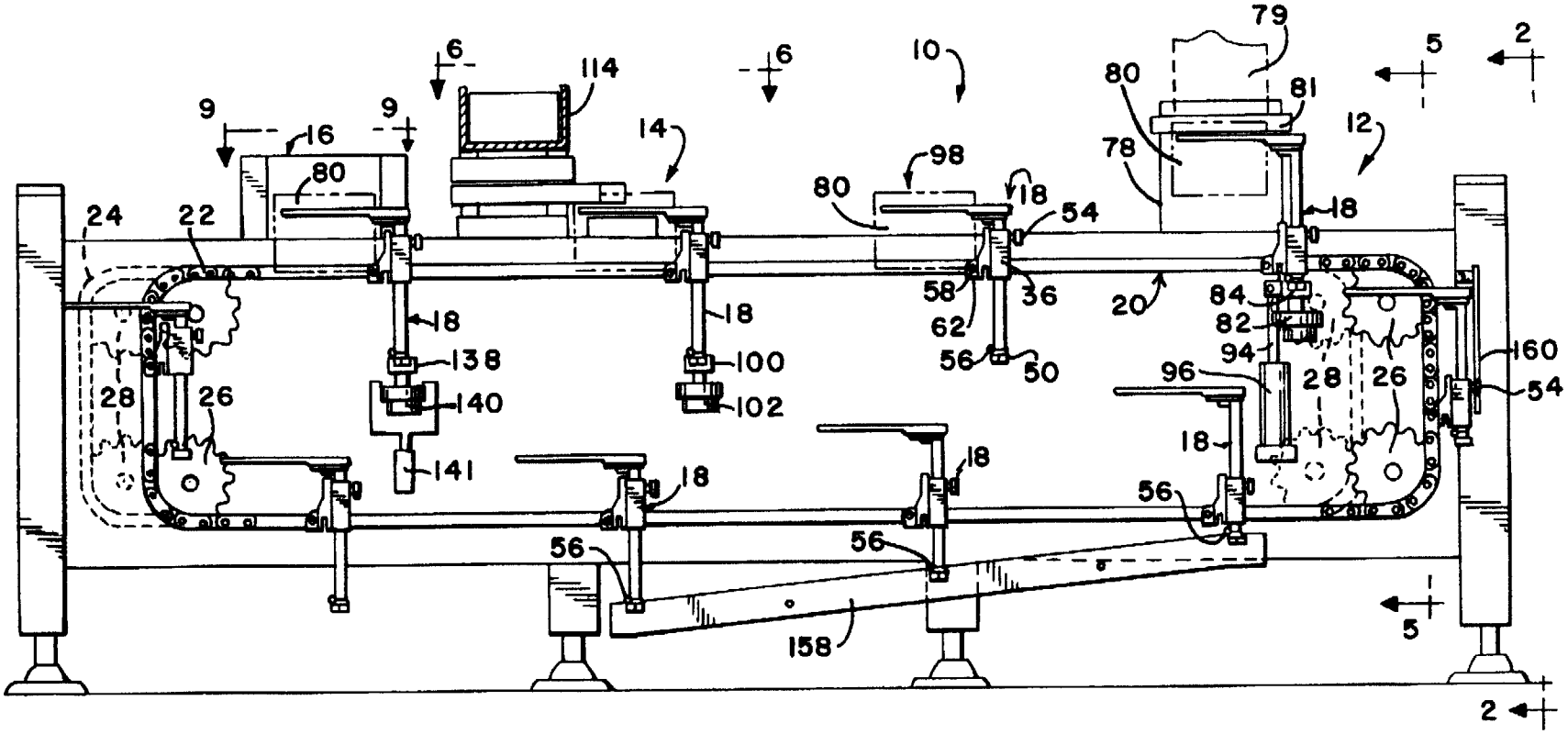
FIG. 1 is a schematic elevational view of a bag gripping and transfer apparatus according to the invention, with certain portions omitted for purposes of clarity.
Figure 4:
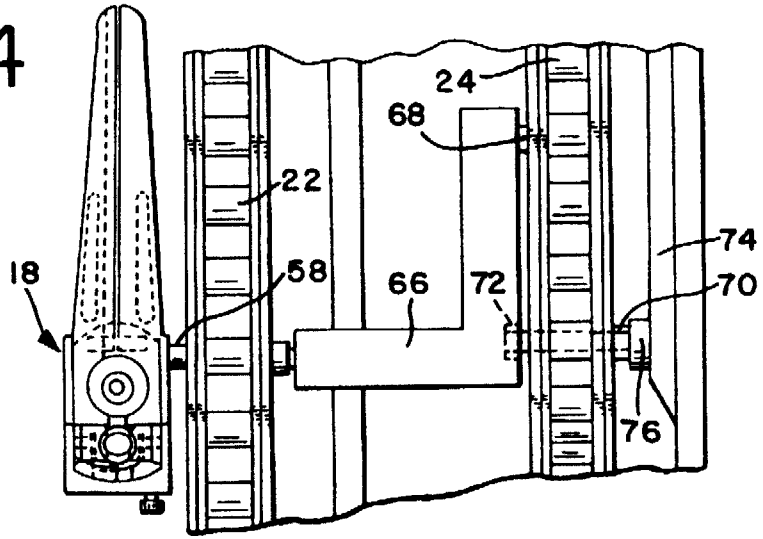
FIG. 4 is a similarly enlarged view taken along lines 4—4 of FIG. 3.
Figure 3:
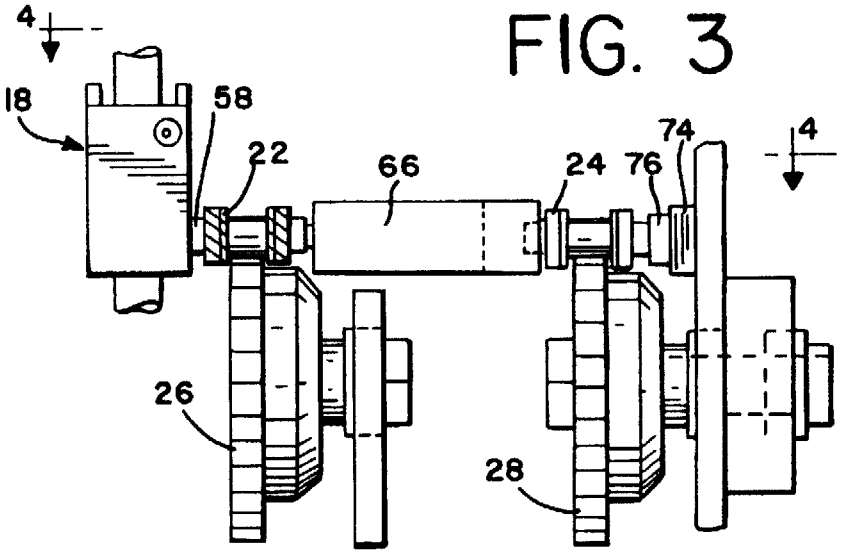
FIG. 3 is an enlarged partial end elevational view similar to FIG. 2, showing additional detail.

A bag gripping and transfer apparatus according to the invention is shown generally at 10 in the drawing figures. The bag gripping and transfer apparatus is a fully automatic, recirculating apparatus, and includes three basic operating stations, an upstream bag presentation and accepting station 12, a midstream label application station 14 located further downstream, and a fully downstream label sealing and bag release station 16. Multiple stations are employed for the fastest possible bag handling. The basic processes of the invention are performed at the three stations 12 through 16, and in order to transfer bags from one location to another, the invention employs a series of grippers 18 which are maintained on and carried by a recirculating transfer conveyor 20. The conveyor 20 is in the form of two chains 22 and 24 which are longitudinally offset in order to maintain the grippers 18 in the upright orientation shown in FIG. 1. The recirculating transfer mechanism disclosed and claimed in U.S. Pat. No. 5,213,198 may be used for the conveyor 20.

The chains 22 and 24 of the conveyor 20 pass over appropriate sprockets, four sprockets 26 for the chain 22 being illustrated, and four sprockets 28 for the chain 24 being illustrated. Obviously, as many or as few sprockets may be employed as are required for proper mounting and revolution of the chains 22 and 24. The chains 22 and 24 are driven in exact synchronism (driving motor not illustrated) so that the grippers 18 are always conveyed in an upright orientation, as explained in further detail below.

Figure 12:
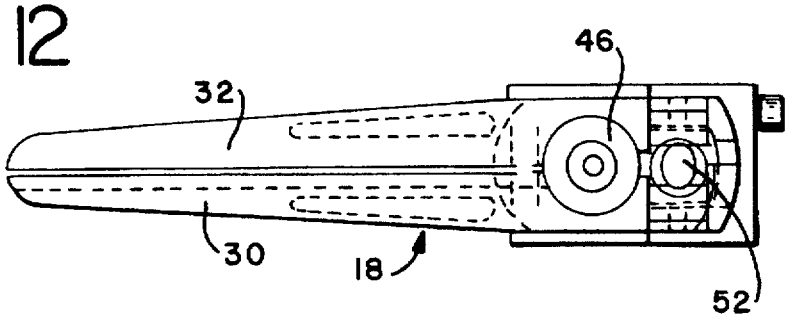
FIG. 12 is a top plan view thereof, shown in a closed position.
Figure 13:
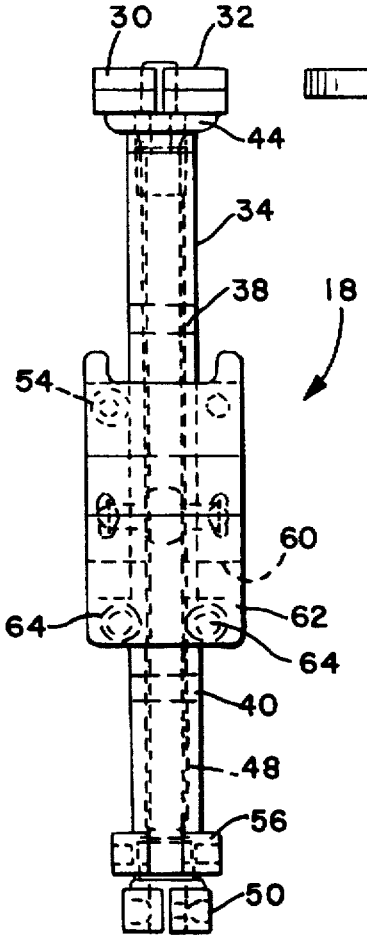
FIG. 13 is a front elevational view thereof.
Figure 11:
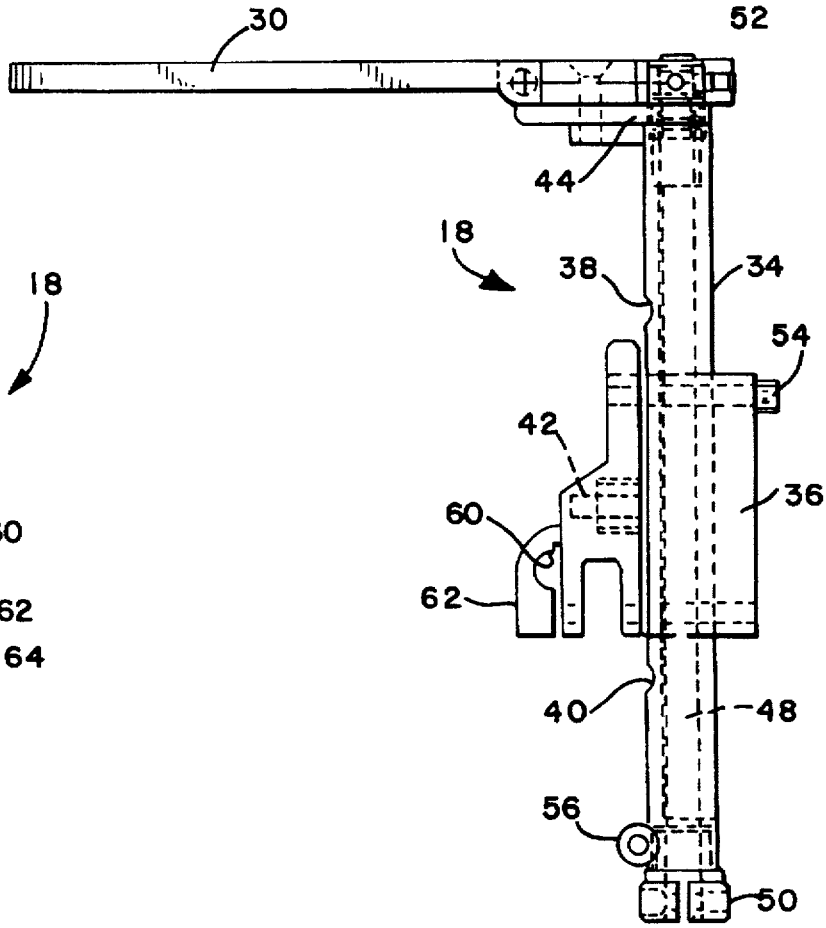
FIG. 11 is a side elevational illustration of one of the grippers and the actuating shaft upon which the gripper is mounted, and showing the shaft within its housing and partially translated between its upper and lower orientations.

Each of the grippers 18, as best shown in FIGS. 11 through 13, is composed of a pair of opposite gripping elements 30 and 32 which are mounted on an actuating shaft 34. The shaft 34, in turn, is mounted in a housing 36 and can be translated in the housing (upwardly and downwardly in relation to FIGS. 11 and 13) between an elevated orientation and a lowered orientation. The orientation shown in FIGS. 11 and 13 is midway between the upper and lower orientations.

The shaft 34 includes an upper detent 38 and a lower detent 40 for temporarily locking the shaft 34 respectively at the lower orientation and the upper orientation. The housing 36 includes a spring loaded locking pin 42 which engages a respective detent 38 or 40 to temporarily retain the gripper 18 at either the lower or upper orientation.

The elements 30 and 32 are mounted on a flange 44 extending outwardly from the top of the actuating shaft 34. The elements 30 and 32 are mounted on a central, spring loaded pivot 46 which biases the elements 30 and 32 in a normally opened orientation (opposite from that shown in FIG. 12). A rotary spindle 48 extends centrally within the shaft 34 between an actuating plug 50 and an eccentric head 52. The plug 50 is generally square in cross section. The eccentric head 52, in turn, extends between the elements 30 and 32. When the eccentric head 52 is rotated to the orientation illustrated in FIG. 12, with its longer axis perpendicular to the elements 30 and 32, the eccentric head 52 forces the elements 30 and 32 closed against the spring force of the central pivot 46. When the eccentric head 52 is rotated one quarter turn from the orientation shown in FIG. 12 (with its longer axis parallel to the elements 30 and 32), the spring force of the central pivot 46 opens the elements 30 and 32 to the extent permitted by the geometry of the elements and the minor axis of the eccentric head 52.

A cam follower 56 is mounted at the base of the actuating shaft 34. A cam follower 54 is mounted on the housing 36. The purposes of the cam followers 54 and 56 will become apparent in the further descriptions below.

The grippers 18 are affixed to the conveyor 20 by means of a series of locating spindles 58 extending laterally from the chain 22. Each spindle 58 has a flat side (not shown in detail), and engages a similarly-shaped hole 60 in a clasp 62 extending from the housing 36. Fasteners 64 are used to tightly secure the clasp 62 to the housing 36 and clamp the spindles 58 within their respective holes 60.

Figure 2:
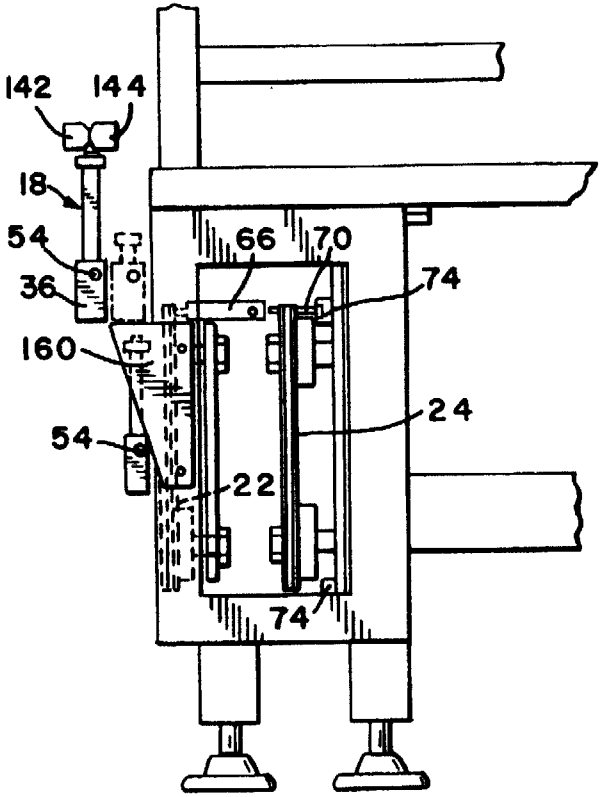
FIG. 2 is a partial end elevational illustration taken along lines 2—2 of FIG. 1, and showing the gripper in both its elevated, outboard position and, in phantom, its lowered, inboard position.

As best illustrated in FIGS. 2 through 5, each spindle 58 extends through a link of the chain 22 into an L-shaped bracket member 66. The bracket member 66, in turn, is permanently pinned at 68 to a link of the chain 24, offset from the spindle 58. As better explained in U.S. Pat. No. 5,213,198, the disclosure which is incorporated herein by reference, the offsetting of the spindle 58 and the pin 68 assures that the grippers 18 are always maintained in the same, upright orientation as best shown in FIG. 1. However, because of the offsetting of the spindles 58 and pins 68, when force is applied to the elements 30 and 32 (such as carrying of a bag), torsional forces will tend to overload the bracket member 68. To avoid overloading, a spring-loaded pin 70 is installed to engage an aperture 72 in the bracket member 66. The pin 70 is normally biased out of engagement in the aperture 72 (to the right in FIGS. 2 through 5), as shown in FIG. 2. However, a cam track 74 is oriented to engage a head 76 on the pin 70, urging the pin 70 into engagement in the aperture 72. That engagement locks the bracket member 66 in place, avoiding the effects of overloading. Cam tracks 74 are located adjacent both the top and bottom horizontal runs of the chain 24 for locking purposes. Appropriate pins 70 are located in the chain 24 for engaging the bracket members 66 along each run.

The bag accepting station 12 is where the outlet of a vertical form, fill and seal machine, designated generally at 78 in FIG. 1, releases a bag 80 to the header label application apparatus 10. The bag 80 is severed from a tube 79 and sealed by sealing jaws 81 of the machine 78 in what may be a conventional fashion. The machine 78 can be any machine for providing bags 80, and although it is preferred that the machine 78 be a vertical form, fill and seal machine, obviously any type of machine or dispensing mechanism capable of supplying appropriate bags in the correct orientation would be acceptable as an input to the bag gripping and transfer apparatus 10. Indeed the bags 80 can be manufactured elsewhere and simply conveyed to or provided to the apparatus 10 for use therein, so long as the bags 80 are properly positioned in the grippers 18. When the machine 78 is a vertical form, fill and seal machine, before the bag is released by the machine, it must be gripped by the gripper 18. Preferably, this occurs before the sealing jaws 81 of the machine are opened. Such a machine is depicted in U.S. Pat. No. 4,288,965, the disclosure of which is incorporated herein by reference.

Figure 5:
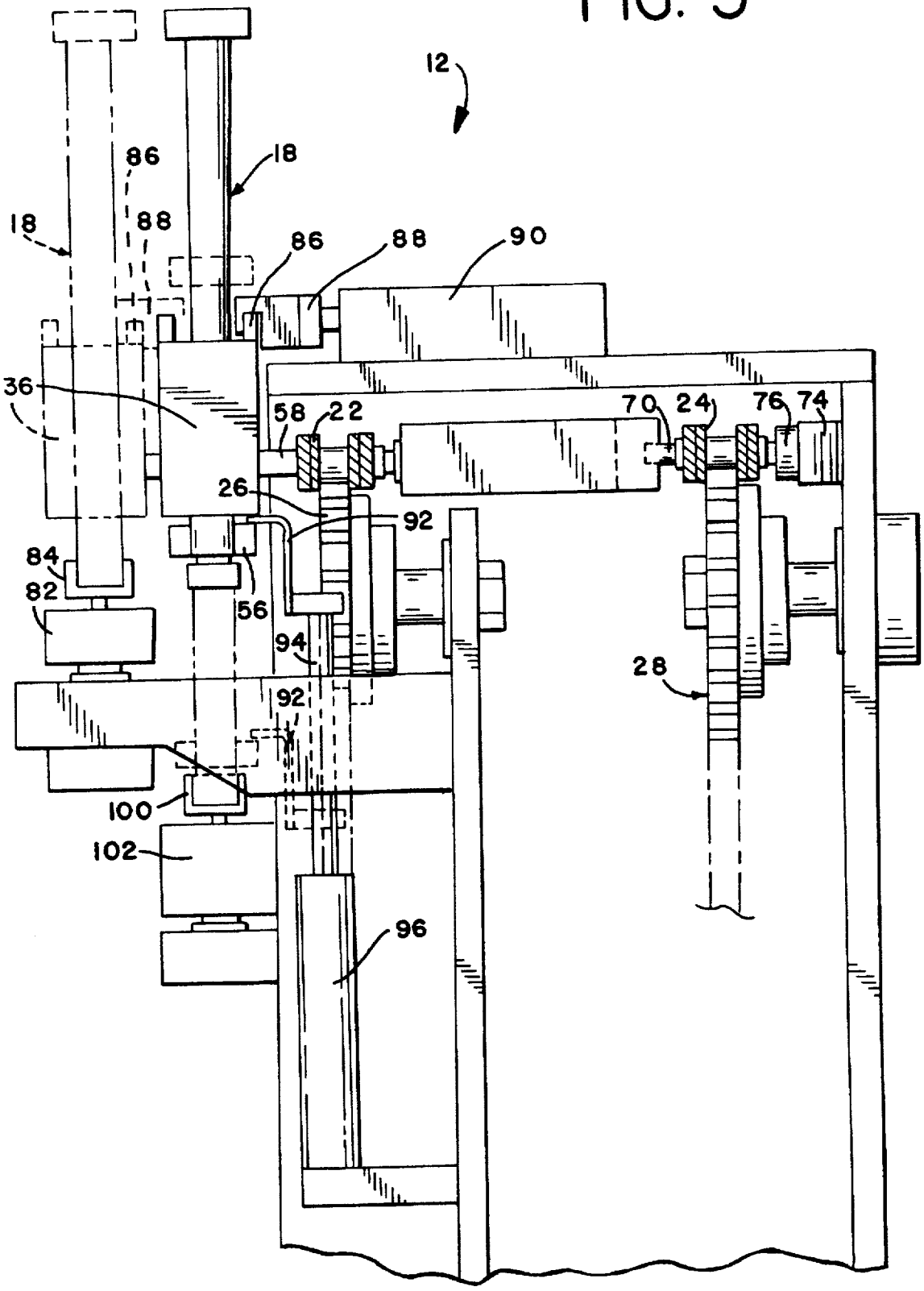
FIG. 5 is an enlarged cross-sectional view taken along lines 5—5 of FIG. 1 and also showing the gripper in bold fashion in the inboard, elevated orientation and in phantom fashion in the outboard elevated orientation and in the inboard, lowered orientation.

At the bag accepting station 12, each gripper 18 is presented at a bag presentation position in the raised, outboard orientation, as shown in FIG. 2, and as shown in phantom at the left in FIG. 5. Preferably, as the gripper 18 approaches the bag accepting station 12, a bag 80 is in the position shown in FIG. 1, and the gripping elements 30 and 32 are opened.

When the gripper 18, conveyed by the conveyor 20, enters the bag accepting station 12, the conveyor 20 stops with the gripper 18 seated in a grip actuator 82 (FIGS. 1 and 5). The actuator 82 includes a rotary cradle 84 which is shaped to engage the actuating plug 50 (FIGS. 11 and 13) of the gripper 18. The actuator 82 is then activated to rotate the cradle 84 one quarter turn, rotating the spindle 48 one quarter turn and therefore closing the elements 30 and 32 on the bag 80.

When the gripper 18 enters the bag accepting station 12, an upstanding lug 86 on the housing 36 (FIG. 5) also engages a gripper element 88 on the extendable ram of a linear actuator 90. After the cradle 84 has been rotated one quarter turn by the grip actuator 82 (to the orientation shown in FIG. 1) and the jaws 81 are opened to release the bag, the linear actuator 90 is then activated to laterally move the housing 36 (and therefore the entire gripper 18) from the outboard orientation (shown in phantom at the left of FIG. 5) to the inboard orientation (shown in bold in FIG. 5). The gripper 18 therefore is inboard in relation to the grip actuator 82 and is in a conveying position, but still in the raised orientation. This move is required to avoid impeding movement of the next bag being formed by the vertical form, fill and seal machine 78. If this move were not made, the vertical form, fill and seal machine 78 could not form the next bag until the bag just clamped is moved out of the way. This could produce a system delay which would reduce the throughput of the apparatus 10.

Once the gripper 18 is in the inboard orientation, the cam follower 56 is located beneath a finger 92 extending from the ram 94 of a vertical actuator 96. The actuator 96 is then activated, lowering the actuating shaft 34 to the lowered orientation (shown in phantom in FIGS. 2 and 5). The lowered orientation is also shown in FIG. 1 to the left of the bag accepting station 12 and in both the label application station 14 and the bag release station 16.

Once the gripper 18 is in the lowered orientation in the bag accepting station 12, and assuming that downstream activities in the label application station 14 and bag release station 16 have been completed (as described in greater detail below), the conveyor 20 is then advanced with the just-gripped bag 80 in the gripper 18 being advanced to an intermediate station 98. The only processing, if any, at the intermediate station 98 is to sense the presence of a gripped bag 80. This information can be used by the apparatus 10 to prevent the initiation of a label placement operation at the label application station 14 if there is no bag coming into the label placement station 14 from the intermediate station 98. If a label were inadvertently deployed, not only would a label be wasted, but potentially a stray label could jam the apparatus 10 in a number of places requiring the apparatus to be stopped to remove the undesired label. Of course, activities at each of the stations 12, 14 and 16 commence in their usual sequences, as described above and to be described below, in the normal course.

Figure 6:
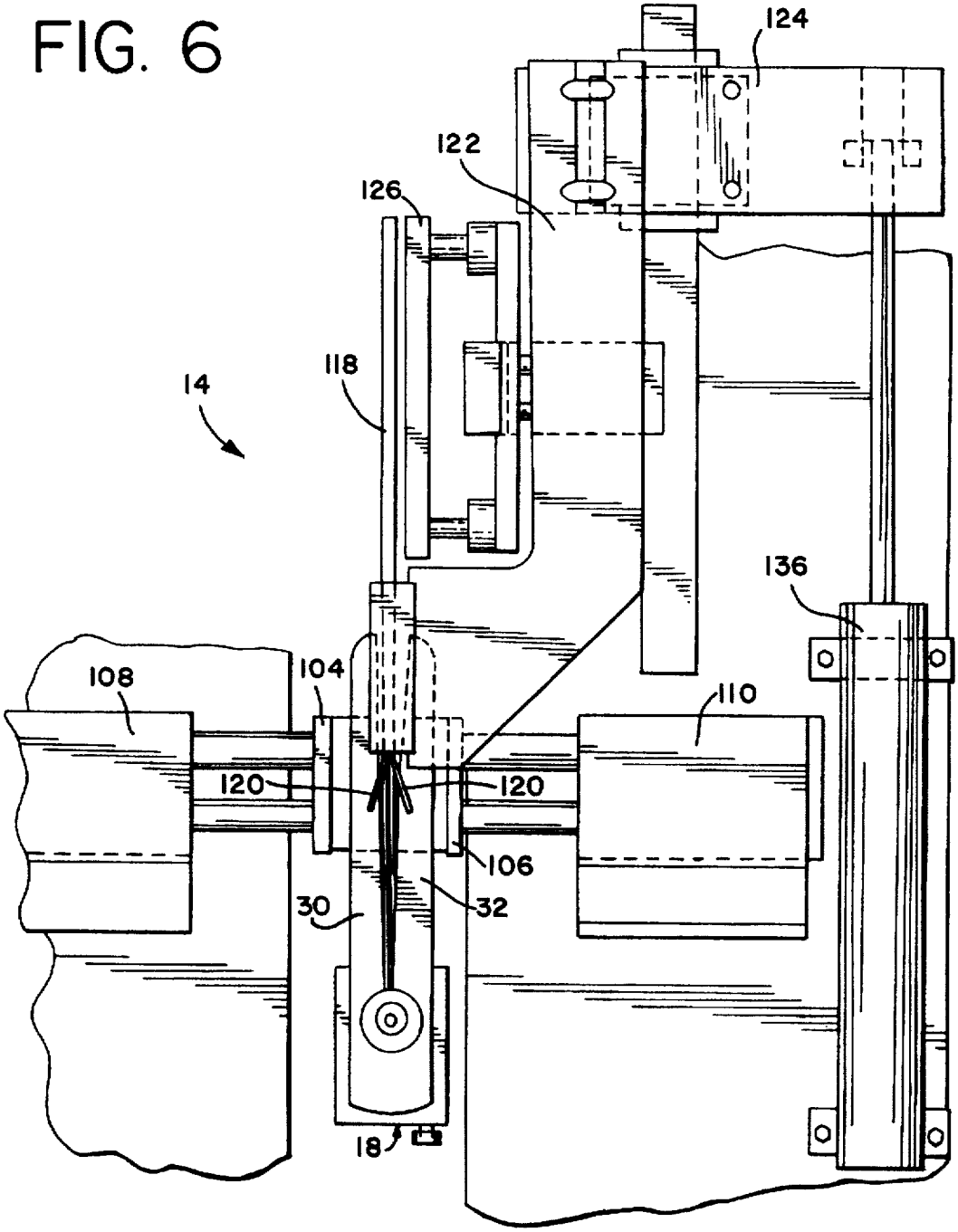
FIG. 6 is an enlarged top plan view taken along lines 6—6 of FIG. 1, with the label applicator omitted to show detail.
Figure 7:
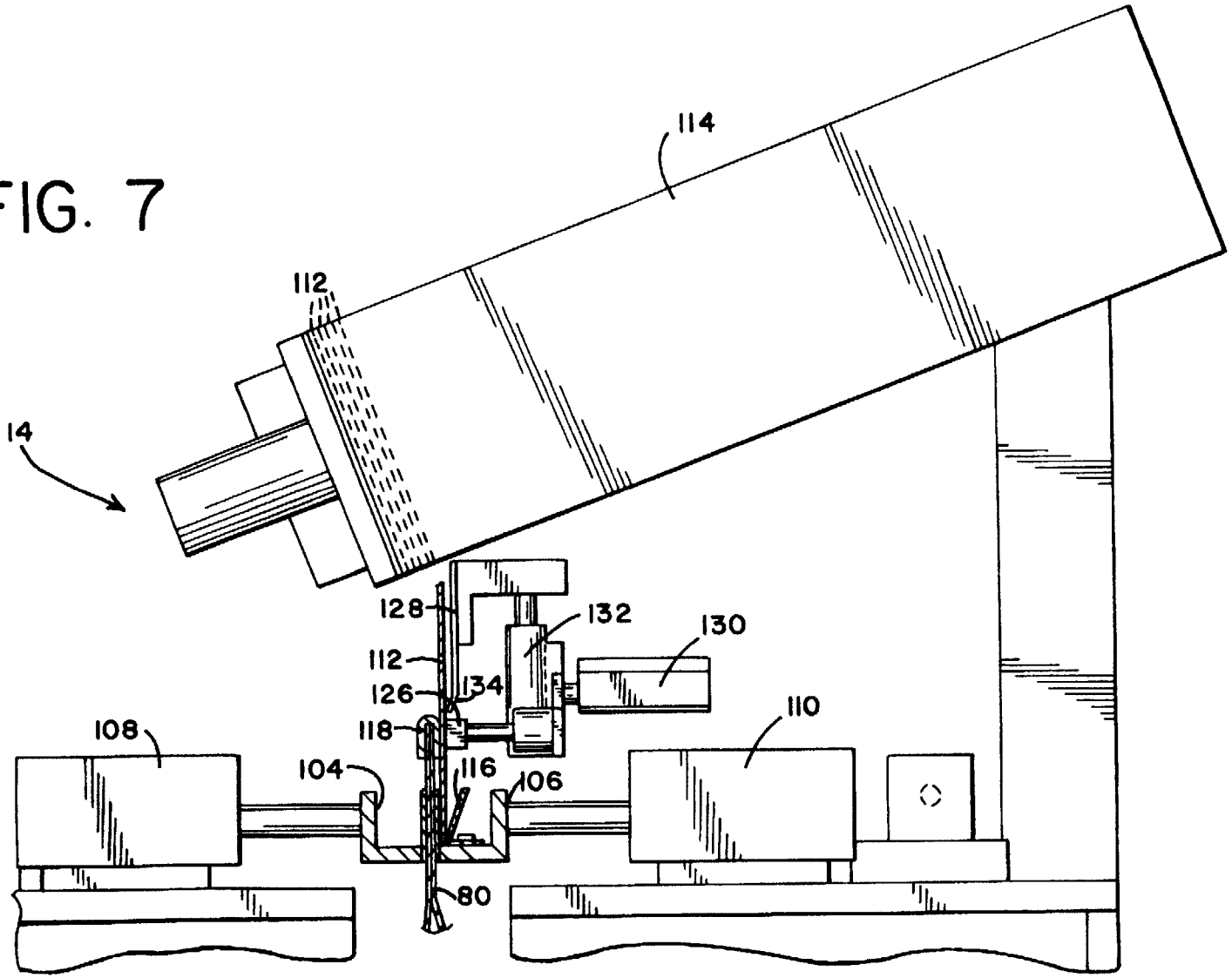
FIG. 7 is a cross-sectional illustration of the same scale as FIG. 6, and showing the header label applicator in place with a label having been removed from the queue and ready for folding over the mandrel prior to application over a bag.
Figure 8:
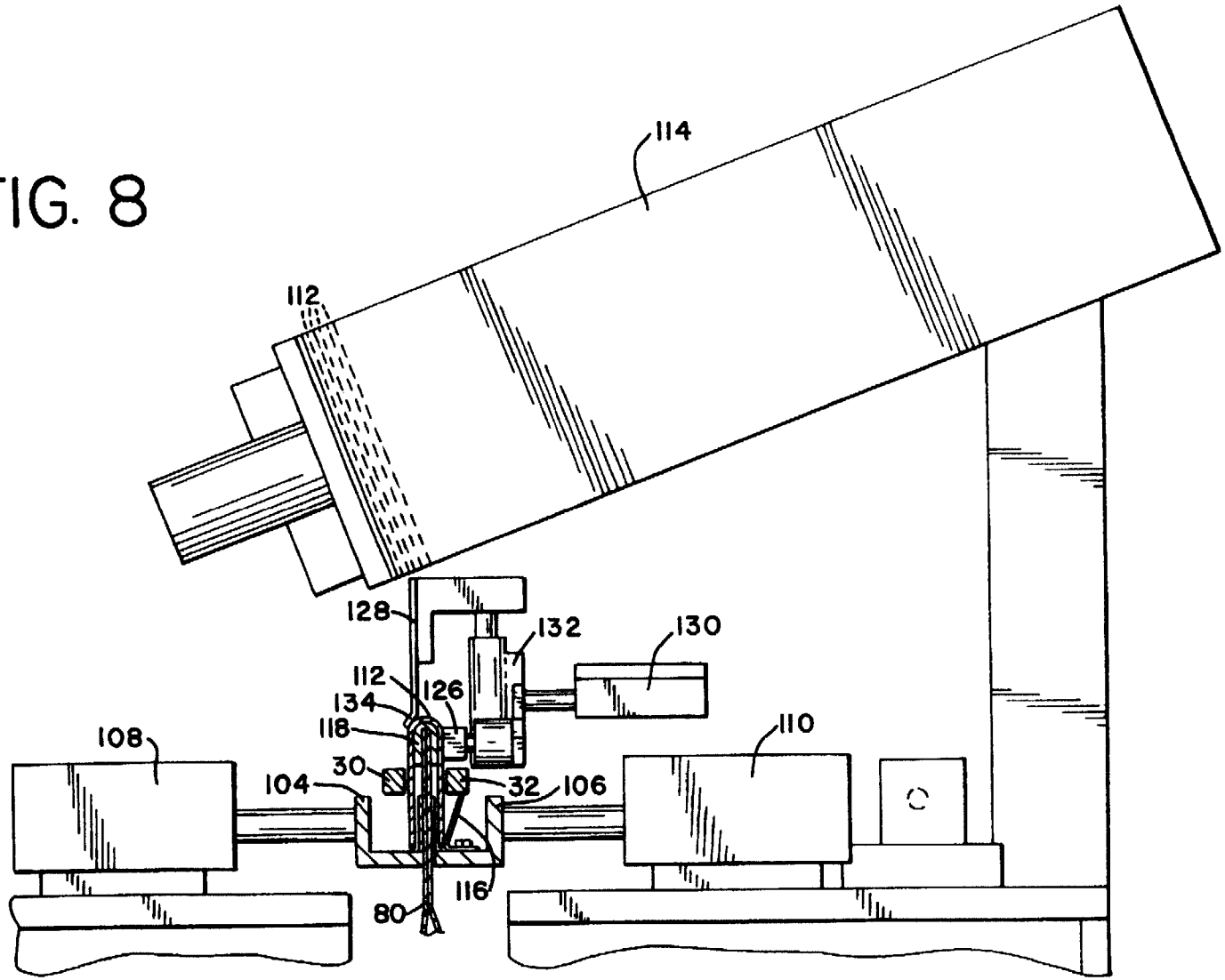
FIG. 8 is a view similar to FIG. 7, but with the label having been folded over and held in relation to the mandrel, and with the entire label orienting, folding, and applying mechanism having been indexed upstream.

The conveyor 20 then advances the gripper 18 to the label application station 14, as shown in FIG. 1 and in greater detail in FIGS. 6 through 8. When the gripper 18 enters the label application station 14, the actuating plug 50 engages a cradle 100 of a second rotary actuator 102. The cradle is initially oriented to accept the plug 50 with the elements 30 and 32 in the closed position. At the same time, a secondary gripper, in the form of opposed clamp elements 104 and 106, is closed on the bag 80 by their respective actuators 108 and 110 beneath the elements 30 and 32 to retain the bag 80 at the label application station 14. The actuator 102 is then activated to rotate the cradle 100 one quarter turn (to the orientation shown in FIG. 1) to open the elements 30 and 32.

At the same time, or in advance of the bag 80 being gripped between the clamp elements 104 and 106, a label 112 is emitted from a label hopper 114. The label hopper 114 may be conventional, and its details form no part of the present invention. The hopper 114 is appropriately formed and located so that single labels 112 can be emitted when desired for label processing.

The label hopper 114 is part of a label orienting, folding and applying mechanism. When the label 112 is emitted, it drops into a label locator or guide 116 adjacent to an elongated mandrel 118. The mandrel 118 as shown in FIGS. 6 through 8, is U-shaped in cross section with an internal channel, and includes an entry guide 120 to guide a bag 80 within the mandrel 118 as the conveyor 20 advances the series of grippers 18. The mandrel, in turn, is mounted on an arm 122 secured to a shiftable frame 124.

Once a label 112 is disposed in the label locator 116, a label clamp 126, also mounted on the frame 124, is activated by an actuator 130 to clamp the label against the mandrel 118. At the same time, a tucker plate 128 is activated to fold the label 112 over the mandrel 118. The tucker plate 128 is activated by two actuators, the actuator 130 and a second folding actuator 132, both of which are mounted on the frame 124. The actuator 130 laterally shifts the tucker plate 128 over the mandrel 118. The folding actuator 132 shifts the plate 128 downwardly toward the mandrel 118 after the actuator 130 is in its fully forward position with the tucker plate 128 over the mandrel 118. The tucker plate 128 includes a bottom foot 134 which, when the actuators 130 and 132 have been activated (as shown in FIG. 8), holds the folded label 112 over the mandrel 118. The combination of the clamp 126 and the bottom foot 134 of the tucker plate 128 then hold the label in position for transport to a waiting bag located upstream.

Once the label has been folded, an actuator 136, secured to the frame 124, is activated to shift the frame 124, and therefore the mandrel 118 with the label 112 folded thereabout, upstream so that the folded label 112 is disposed over the bag 80 and between the opened elements 30 and 32 (as in FIG. 8). The rotary actuator 102 is then reactivated to rotate the cradle 100 one quarter turn to reclose the elements 30 and 32 on both the folded label 112 and the top of the bag 80. With the bag and label therefore captured between the elements 30 and 32, the actuators 108 and 110 are deenergized and the clamp elements 104 and 106 return to their retracted positions. When both have been fully retracted and the remaining stations 12 and 16 have completed their respective cycles and the bag maker 78 is in the correct phase of its cycle, the conveyor 20 is activated, indexing the gripper 18 and removing the folded label laterally from the mandrel 118, advancing the bag 80 and the folded label 118 to the station 16.

The station 116 includes a cradle 138, a further rotary actuator 140, and a pair of heat sealing jaws 142 and 144. The jaw 142 is fixed to an overhead frame 146, while the jaw 144 is linearly displaceable by an actuator 148 also mounted in the frame 146. The entire frame assembly 146 may be vertically adjusted by means of a conventional handwheel arrangement 150 which is therefore not described in greater detail.

In operation, after the sealing jaws 142 and 144 have closed, the bag and label are suspended by the sealing jaws and the rotary actuator 140 is energized to unclamp the elements 30 and 32 of the gripper 18. Since the conveyor 20 cannot move with the cradle 138 rotated in the unlocked position (as shown in FIG. 1), and it is necessary to leave the station 16 with the gripper open, it is necessary to lower the actuator 140 and the cradle 138 to the point where the gripper 18 can pass over the cradle 138 without touching it. This is accomplished by using a lift actuator 141 as illustrated in FIG. 1. Once the conveyor 20 begins its next movement, the actuator 140 is rotated one quarter turn to accept the next gripper 18, and simultaneously the lift cylinder 141 is raised to engage the cradle 138 with the next gripper entering the station 16.

When a bag 80 with the folded label 112 enters the station 16, the jaw 144 is initially retracted by the actuator 148. When the gripper 18 is in place (with the actuating plug 50 engaged in the cradle 138), the actuator 148 is activated to close the jaws 142 and 144, applying heat and pressure in order to seal the folded label 112 to the bag 80. Preferably, the bag 80 is made of plastic and the label 112 is made of paper. By the application of heat and pressure between the jaws 142 and 144, plastic of the bag 80 migrates into the fibers of the paper label 112, sealing the label to the bag. Alternatively, the label 112 can be coated with an appropriate plastic material so that when heat and pressure is applied, the label 112 readily adheres to the bag 80. Under normal circumstances, however, coating of any kind is not required.

Figure 9:
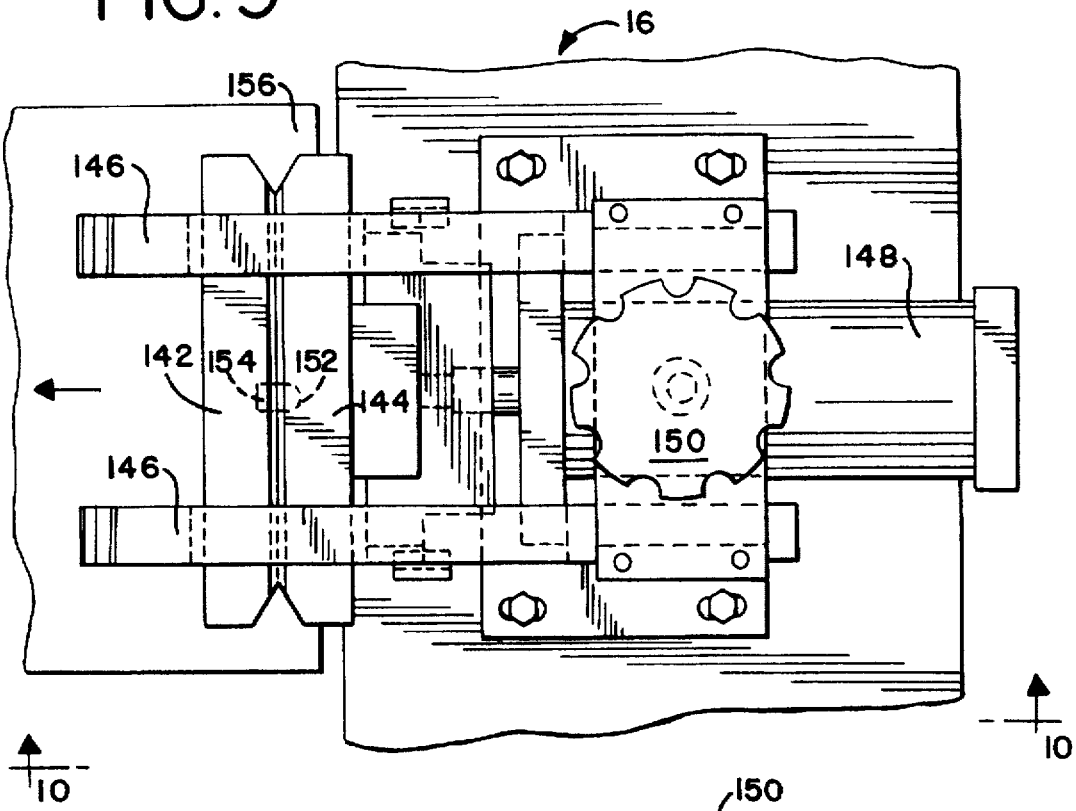
FIG. 9 is an enlarged top plan view taken along lines 9—9 of FIG. 1.
Figure 10:
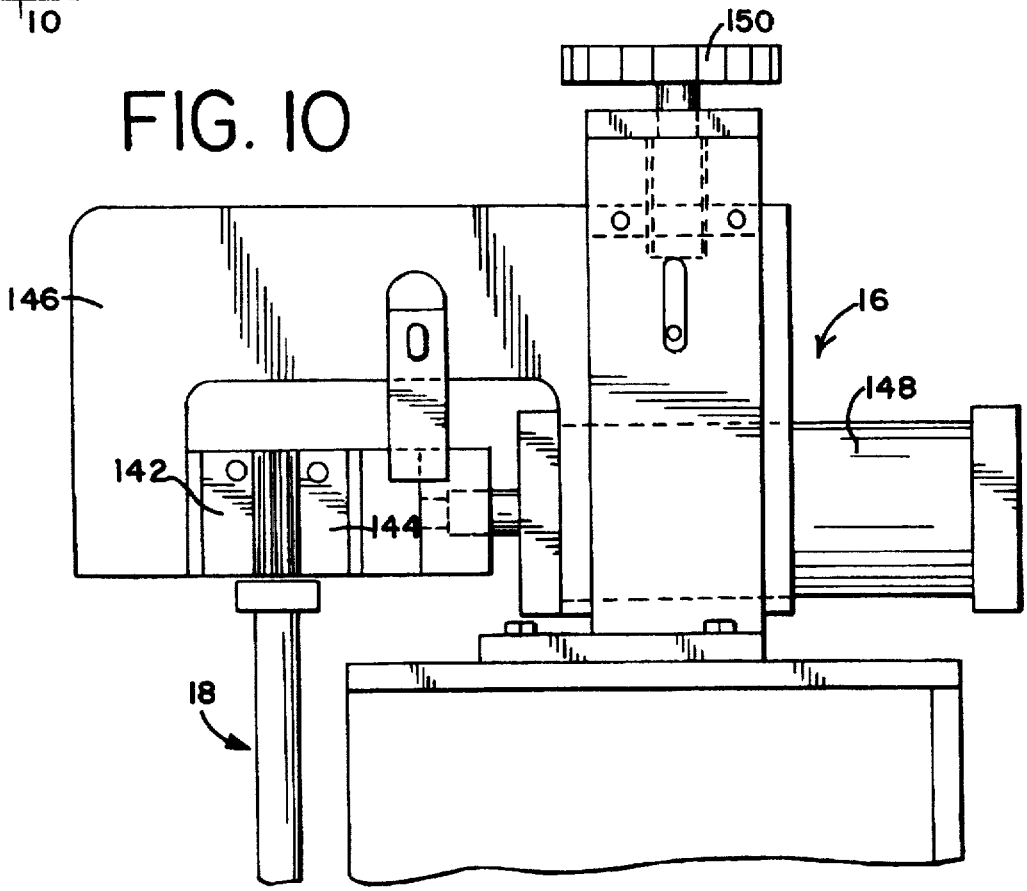
FIG. 10 is a view of similar scale taken along lines 10—10 of FIG. 9.

The finished package can also be hole punched at the station 16. The jaws 142 and 144 include a hole punch for that purpose. As shown in FIG. 9, a punch ball 152 is located in the jaw 144. A cavity 154 is located in the jaw 142, the cavity conforming to the punch ball 152 and having sharp edges so that when the jaws 142 and 144 are closed, the ball severs a circular hole in the finished package. Preferably, the punched material is not completely severed from the bag since the cavity 154 would soon be filled. Instead, the rim of the cavity 154 is sharp except for a very small section so that a hole is completely punched except for that small section. Then, when the jaws 142 and 144 open, a hole appears in the bag, but the punched material remains attached to the bag as it is released.

After the label 112 has been sealed to the bag 80, it is released from both the heat sealing jaws 114 and also the gripper 18. The actuator 148 is activated to open the jaws 144. The finished bag drops from the jaws by gravity force, preferably onto a conveyor 156 (FIG. 9) which transports the finished bag for further handling or packaging.

As explained above, the bags 80 are accepted at the station 12 with the gripper 18 oriented with the shaft 34 in the raised orientation and with the housing 36 in the outboard orientation. However, when a gripper 18 departs the station 16, the shaft 34 is in the lowered orientation, and the housing 36 is in the inboard orientation. To return the shaft 34 to the raised orientation, a cam track 158 is oriented to engage each of the grippers 18 as they return to the station 12. As seen in FIG. 1, the cam track 158 is inclined, and engages each cam follower 56 to raise the shaft 34 to the elevated orientation.

Next, as a gripper 18 commences the vertical leg of its travel along the conveyor 20 as it returns to the station 12, the cam follower 54 engages an outwardly inclined cam 160. The housing 36 is therefore shifted to the outboard orientation and is ready to be presented to the bag accepting station 12.

The operation of all of the actuators and the conveyor 20 is controlled by an appropriate means (not illustrated), such as a computer which is programmed to control the functions of the various elements of the invention as described above and in the sequence of operation to be described below. A general purpose computer or programmable controller can be used for that purpose, or a special processor can be constructed to perform the various functions of the invention. Given the description of the invention, providing an appropriate controller would be apparent to one skilled in the art. In addition, although not illustrated in the drawings or described above, various sensors can be located in the apparatus 10 to assure that steps of operation have taken place before the conveyor 20 is reactivated or various ones of the actuators are activated. For example, a sensor can be located to sense a label 112 as it is emitted from the label hopper 114 into the label locator 116 in order to assure that the label has been fully seated in the label locator 116. Other sensors can be located throughout the apparatus 10 for similar and other purposes.

The bag gripping and transfer apparatus 10 is operated in a continuous fashion with the gripper 18 stopping temporarily at each of the stations 12, 14 and 16 for performance of the various functions at those stations. The sequence of operation of the apparatus 10 will now be explained, tracing the path of travel of one gripper 18, beginning at the bag accepting station 12 and ending as the gripper 18 returns to the bag accepting station 12 in the sequence of operation of the apparatus 10.

At the bag presentation and accepting station 12, the gripper is oriented with the housing 36 in the outboard orientation and the actuating shaft 34 raised to the elevated orientation. The elements 30 and 32 are opened to accept a bag 80 as it enters the apparatus 10 from the vertical form, fill and seal machine 78.

With the bag 80 poised between the opened elements 30 and 32, the rotary actuator 82 is activated to rotate the cradle 84 one quarter turn, closing the elements 30 and 32 to grip the bag 80. When the jaws 81 open, the actuator 90 is activated to withdraw the housing 36 from the outboard orientation to the inboard orientation. Immediately thereafter, the actuator 96 is activated to withdraw the shaft 34 from the elevated orientation to the lowered orientation. The station 12 has now completed its process steps and is ready to allow the gripped bag 80 to be transferred downstream. When the stations 14 and 16 have completed their processing steps and a command signal is received by the controller to index the gripper 18, the conveyor 20 is then activated to advance the lowered and inboard gripper 18 to the intermediate station 98 from the accepting station 12. The gripper 18 is then advanced in sequence to the label application station 14.

At the label application station 14, the actuators 108 and 110 are activated to close the clamp elements 104 and 106 on the bag 80 beneath the elements 30 and 32. The rotary actuator 102 is then activated to rotate the cradle 100 one quarter turn to open the elements 30 and 32. At the same time, a label is dispensed from the label hopper 114 to the label pocket guide 116. The label clamp 126 is activated by the actuator 130 to clamp the label 112 against the mandrel 118, and the actuator 132 is activated to fold the label 112 about the mandrel 118 and retain the label in place in its folded orientation. The actuator 136 is then activated to shift the folded label 112 and mandrel 118 upstream directly above the bag 80 as it is clamped between the clamp elements 104 and 106. The gripping elements 30 and 32 are then closed (by rotating the cradle 100 one quarter turn), and the clamp elements 104 and 106 are opened. The conveyor 20 is then activated to index the gripped label and bag off the mandrel 118 from the station 14 to the station 16.

At the station 16, the actuator 148 is activated to close the jaws 142 and 144. The jaws 142 and 144 apply heat and pressure to seal the label 112 to the bag 80. Also, a hole is optionally punched through the label and bag by the ball 152 and cavity 154. After the sealing jaws 142 and 144 have closed, the bag 80 and the label are suspended and the rotary actuator 140 is energized to unclamp the gripping elements 30 and 32. The bag is then released. The cradle 138 and the actuator 140 are lowered by the lift actuator 141 sufficiently beneath the gripper 18 to allow the gripper 18 to pass over the cradle 138 without interference. Once the conveyor 20 is then reenergized to index the gripper 18, the rotary actuator 140 is energized to rotate the cradle 138 one quarter turn to accept the next gripper, and simultaneously the actuator 141 is raised to engage the next gripper 18 as it enters the station 16.

Thereafter, the gripper 18 advances with the conveyor 20 to the cam track 158, where the cam follower 56 is engaged to raise the shaft 34 to the elevated orientation. As the gripper 18 begins its final vertical leg, the cam follower 54 engages the cam 160, shifting the housing 36 to the outboard orientation. As the cam follower 54 leaves the cam 160, the gripper 18 is poised with the housing 36 in the outboard orientation and the actuating shaft 34 in the elevated orientation, ready to accept a further bag 80 as it emanates from the vertical form, fill and seal machine 78.

Figure 14:
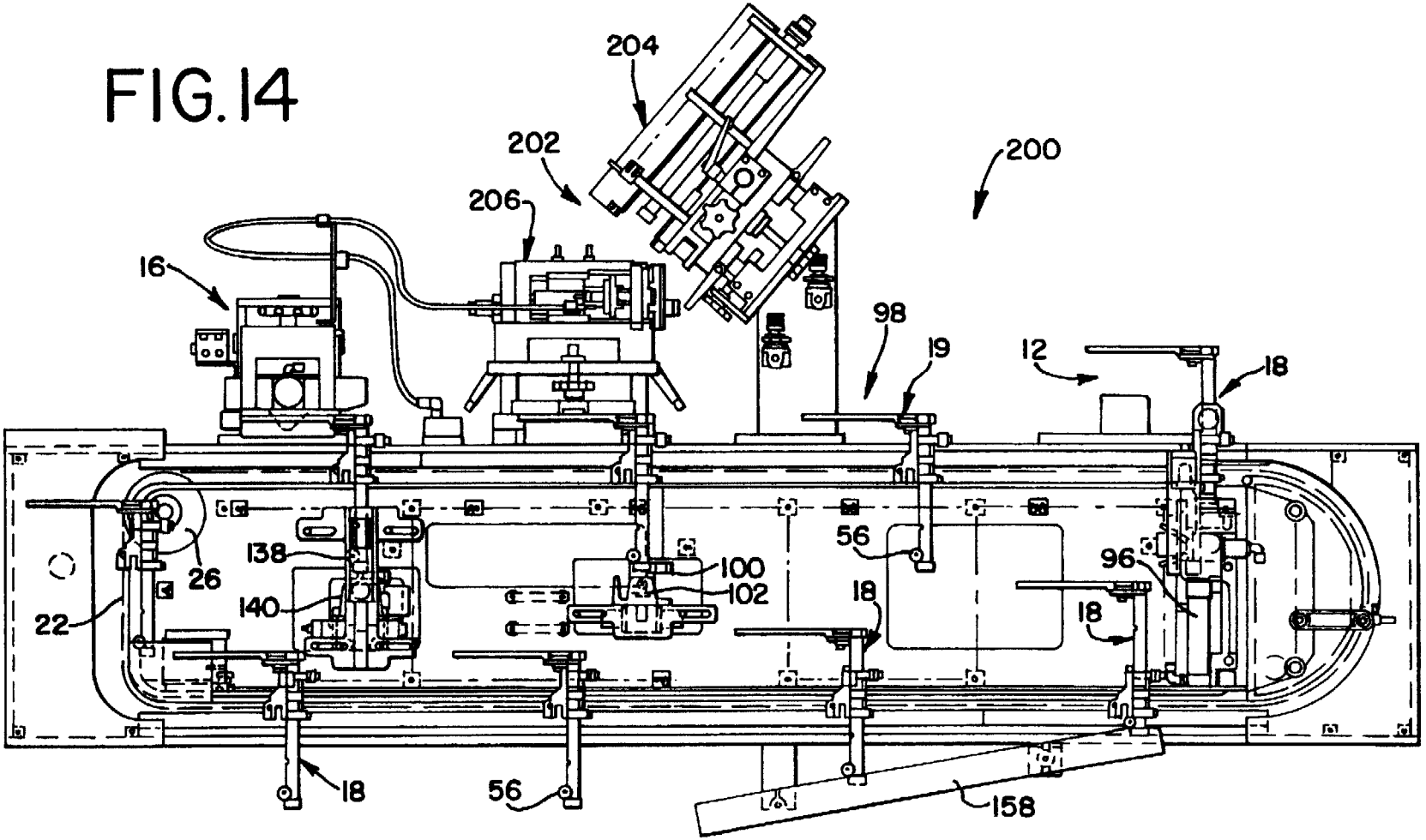
FIG. 14 is a schematic elevational view of a second form of a bag gripping and transfer apparatus according to the invention, again with certain portions omitted for the purposes of clarity.

A second form of the bag gripping and transfer apparatus according to the invention is shown generally at 200 beginning in FIG. 14. Those elements of the invention which remain the same bear the same reference numerals as illustrated in FIGS. 1 through 13, and reference should be made to the above description and those figures for greater detail. The following description is generally directed to a revised form of application of labels to the bag 80, and not the specific nature of upstream handling or downstream heat sealing of the label and other handling of the bag. Thus, while other elements of FIG. 14 may be somewhat different in their depiction than shown in FIGS. 1 though 13, the function and operation of the apparatus 200 is the same as that described above, with the exception of the label application station 202, which is described immediately below.

Figure 15B:
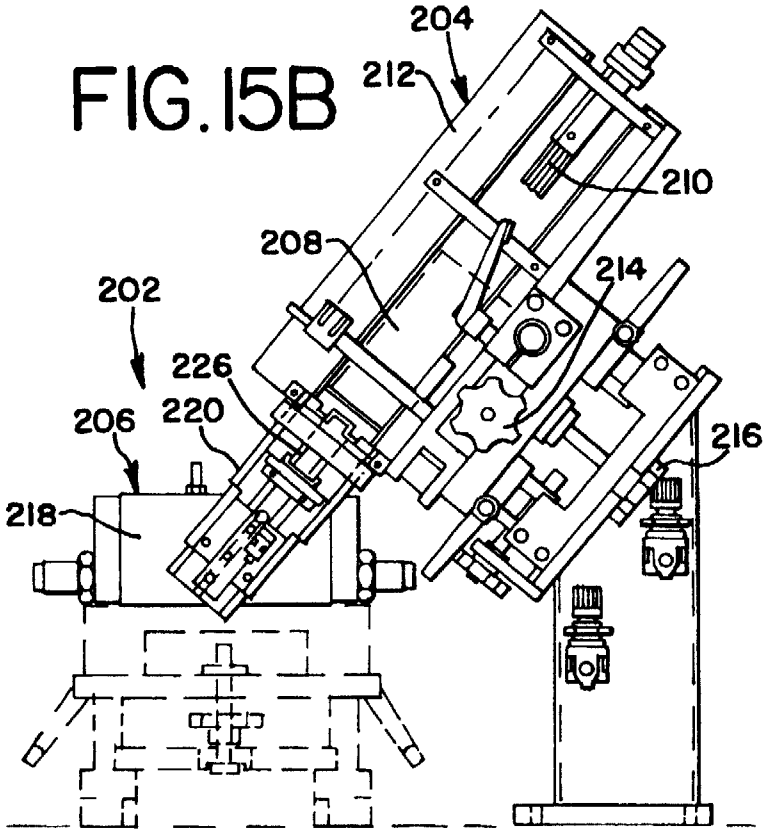
FIGS. 15A through 15G are enlarged elevational illustrations of the label application portion of the invention, showing the various steps of obtaining a label and applying it to the top of a bag, and FIGS. 16A through 16C schematically illustrate, from an overhead orientation, the steps of selecting and folding a label prior to application to the top of a bag.
Figure 15A:
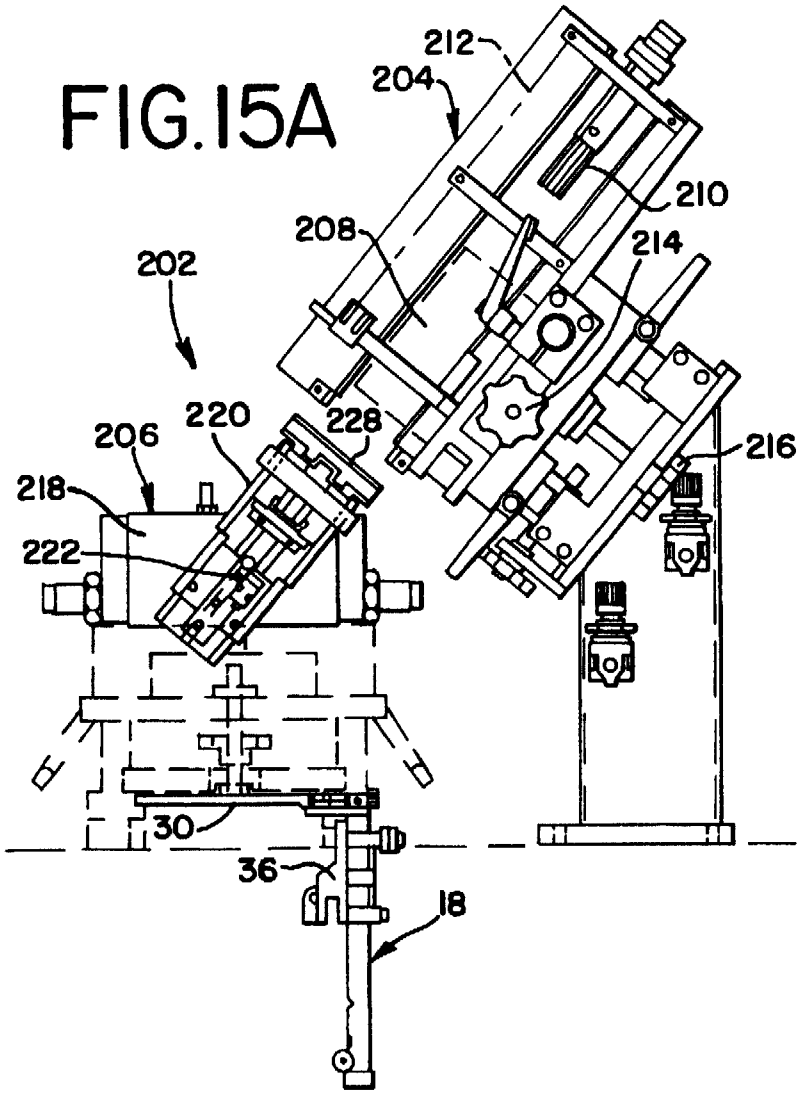
Figure 15D:
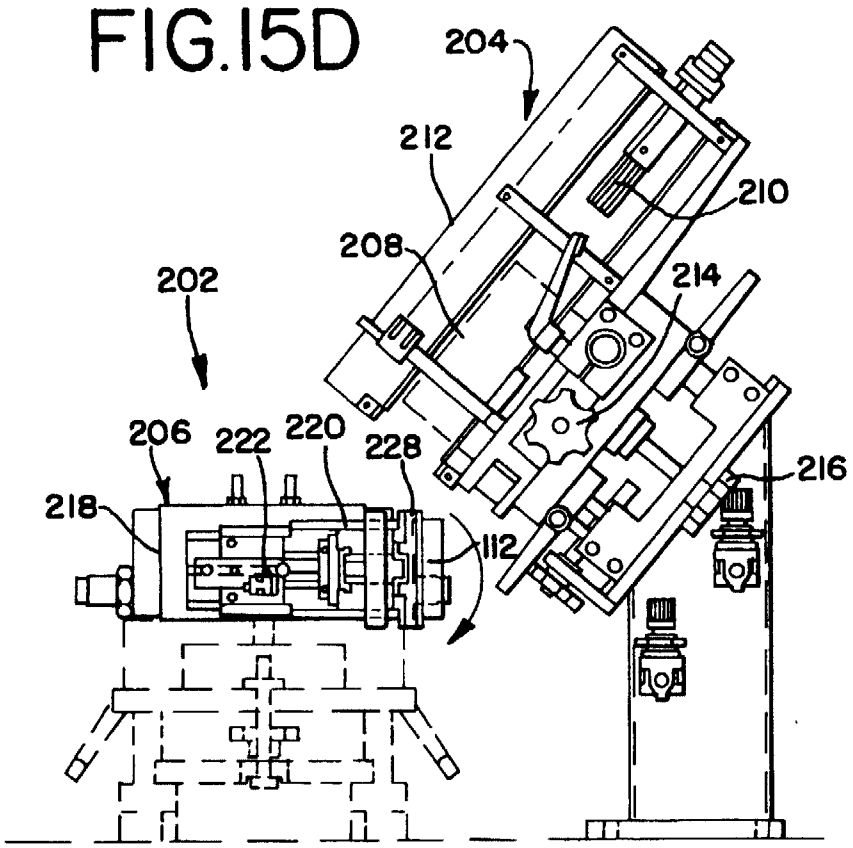
Figure 15C:
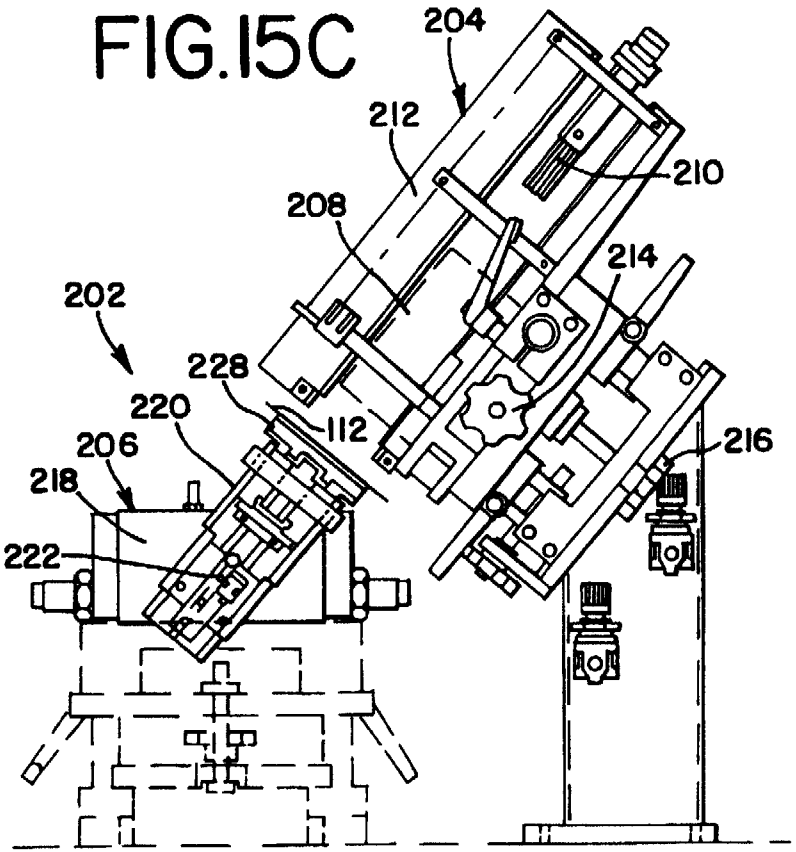
Figure 15F:
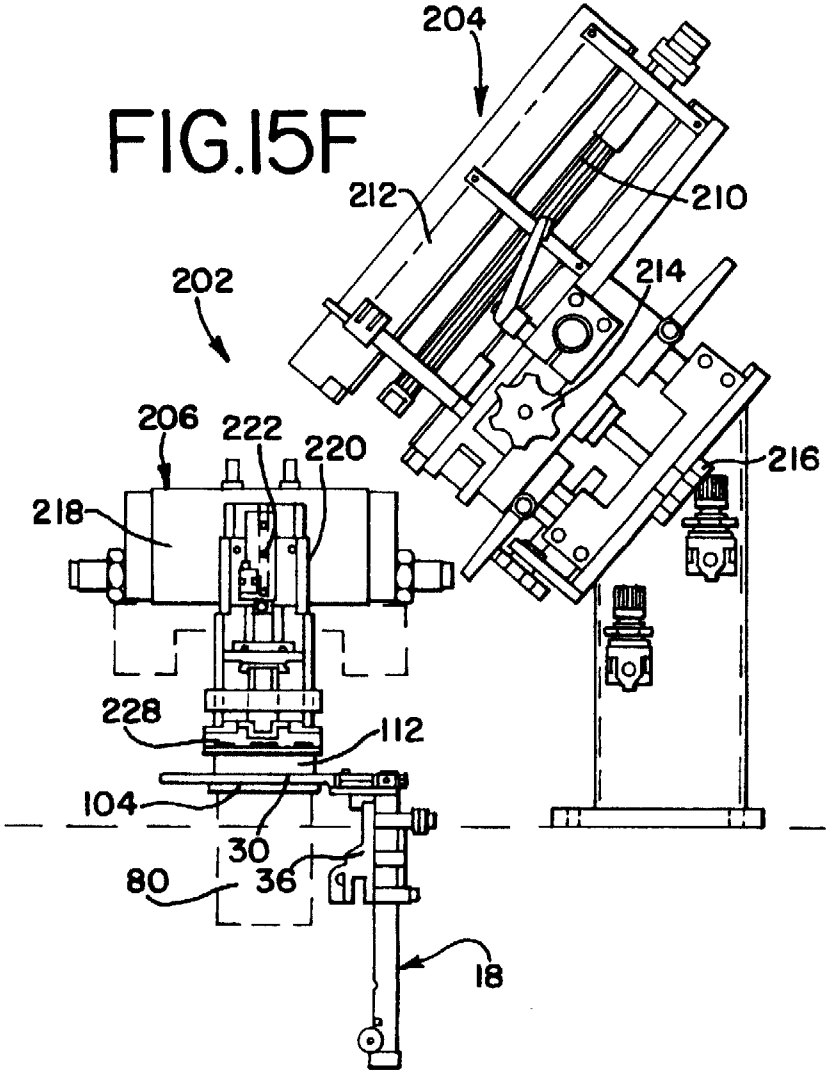
Figure 15E:
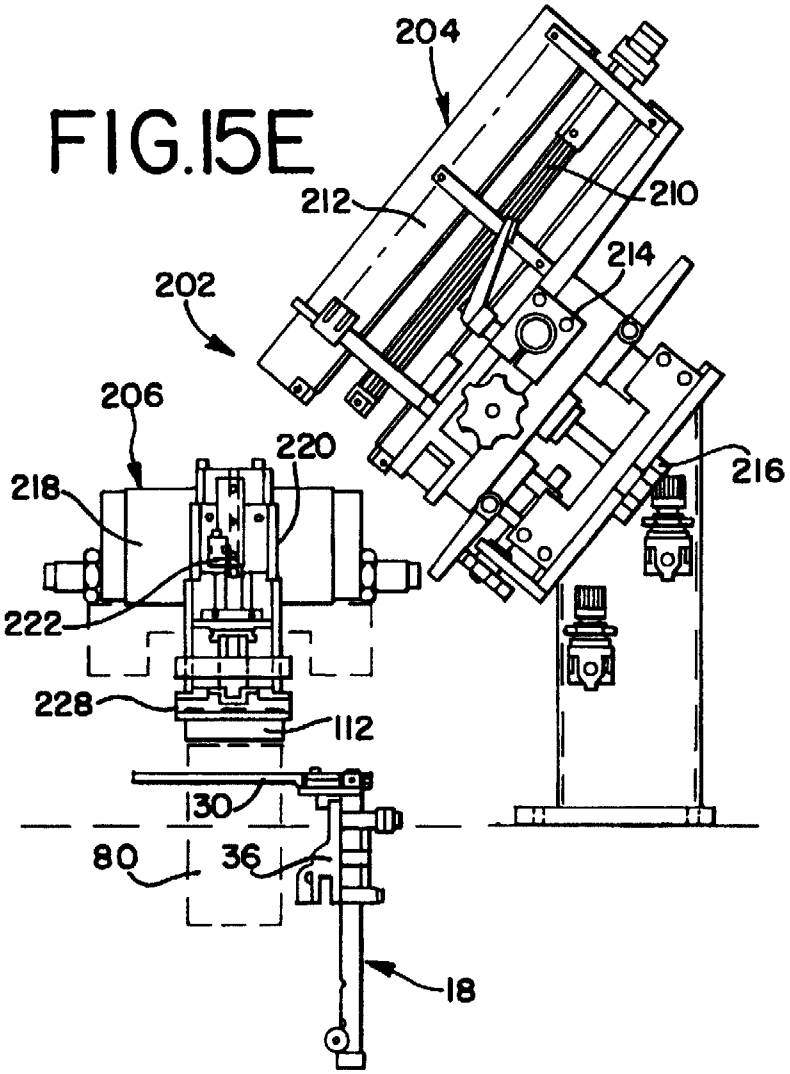
Figure 15G:
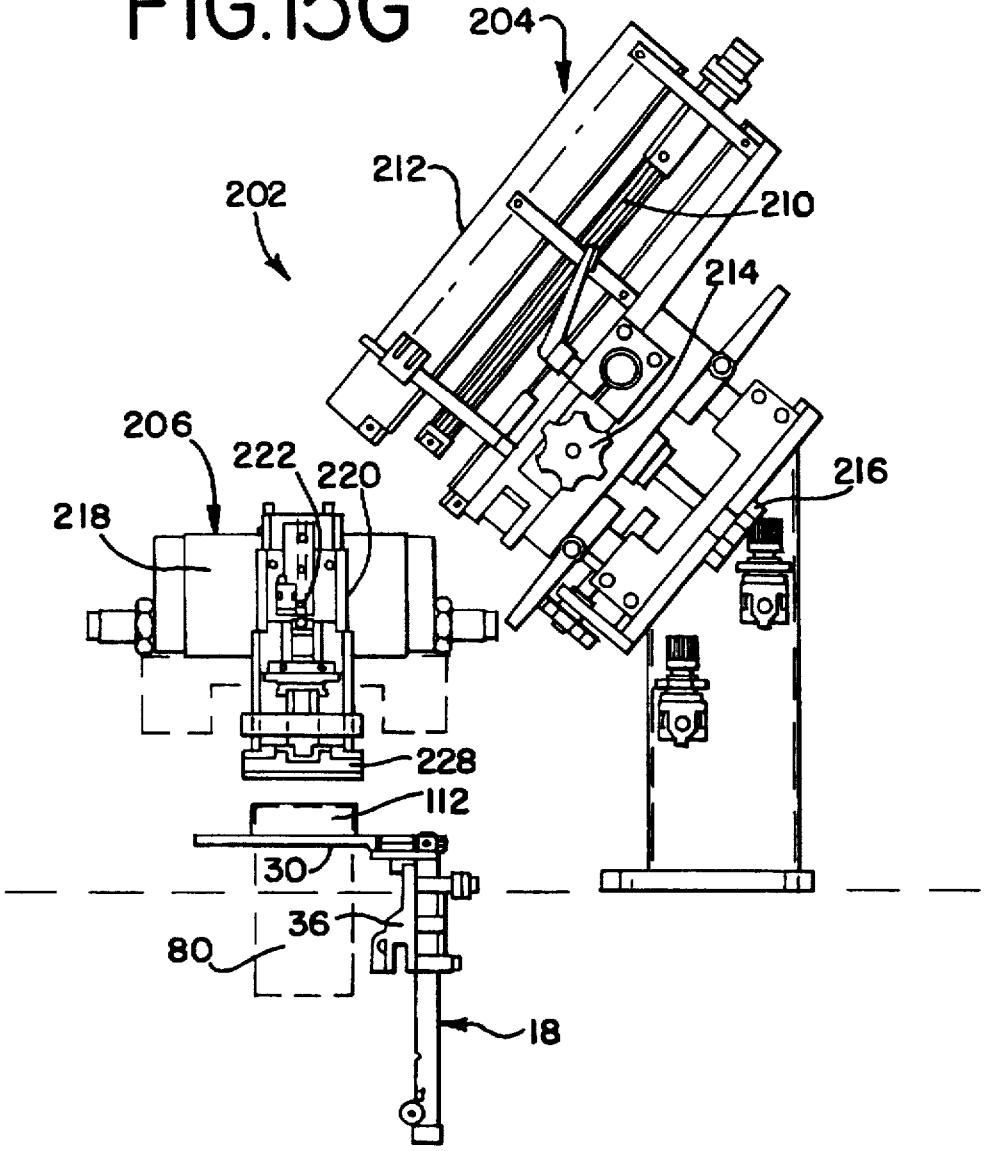
Figure 16A:
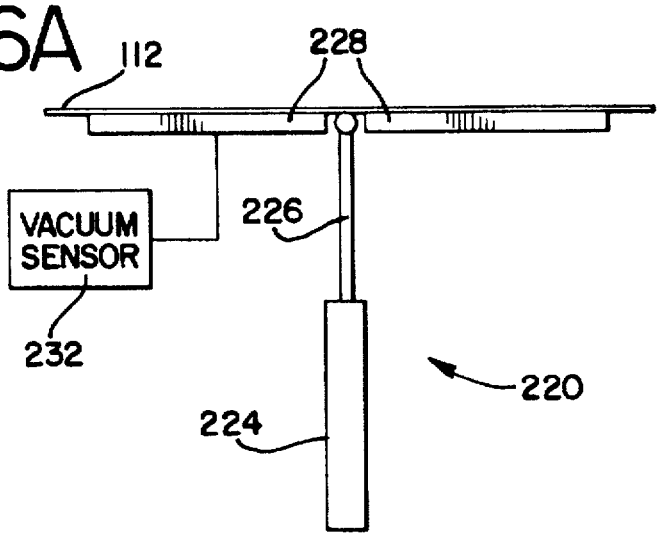
Figure 16B:
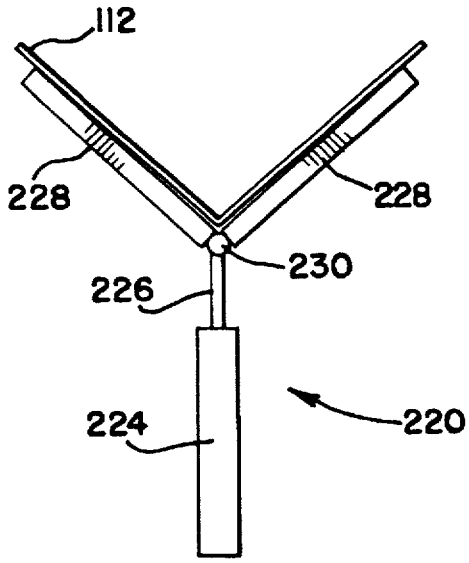

The label application station 202, as better illustrated in FIGS. 15 and 16, comprises two basic components, a magazine or supply of labels 204, and a pick-off and folding device 206. The two parts 204 and 206 work in cooperation, as will be seen below.

The magazine 204 is disposed at an angle relative to the pick-off and folding device 206 and to plastic bags 80 that are being carried by the primary grippers 18 through the apparatus 200. The magazine 204 includes a chute carrying a stacked supply of individual labels 208. Opposite arms 210 hold the labels in place for presentation to the pick off and folding device 206, in a conventional fashion. The arms 210, only one of which is shown in the drawing figures, are broken away to illustrate detail in FIGS. 15A through 15D, and are shown in full extent in FIGS. 15E through 15G.

The chute portion of the magazine 204, which is designated generally at 212, is adjustable toward and way from the pick off and folding device 206 by means of a handwheel 214 and appropriate adjustment means, such as a rack and pinion arrangement (not illustrated). A second handwheel 216, oriented perpendicularly to the handwheel 14, is used to raise and lower the chute 212. Adjustment for the chute 212 can be conventional, and is therefore not described in greater detail.

The magazine 204 presents individual labels 112 from the label supply 208 to the pick off and folding device 206. The device 206 comprises two basic portions, a fixed housing 218 and a rotatable and extendable pick off arm 220. The housing 218 remains in place during operation of the label application station 202, while the pick off arm 220 is the active element for selecting a label 112, folding the label and applying it to a bag 80. The pick off arm 220 rotates about a pivot point 222, as will be seen below.

FIG. 16 illustrates schematically the operative elements of the pick off arm 220, and their operation to pick up and fold a label 112. The pick off arm 220 includes an air cylinder 224 having an extensible piston 226. A label handling head 228 for holding and folding a label 112 is mounted at one end of the piston 226, the label handling head comprising a vacuum plate 228 having a central hinge 230. The vacuum plate 228 can be formed in a conventional fashion, having a series of holes therein so that when vacuum is applied (again in a conventional fashion), a label 112 will adhere to the vacuum plate 228. A vacuum sensor 230 is connected to the vacuum plate 228 to sense the degree of vacuum in the vacuum plate 228.

The bag gripping and transfer apparatus 200 operates in the following sequence. With a bag 80 located at the label application station 202, the jaws 104 and 106 of the secondary gripper are closed beneath the gripping elements 30 and 32 of the primary gripper 18. The primary gripper 18 is then opened to permit the top of the bag 80 to be exposed to allow a label 112 to be applied thereto.

The rest position for the label application station 202 is illustrated in FIG. 15A. At the same time that the bag 80 is being gripped in place by the secondary grippers, the air cylinder 224 is activated to extend the vacuum plate 228 toward the labels 112 of the label supply 208, as shown in FIG. 15B. When the labels are encountered, vacuum is applied to the vacuum plate 228 to select one label 112, and the piston 226 is retracted as shown in FIG. 15C. If, on the other hand, a label 112 is not picked off, the lack of vacuum can be sensed by the vacuum sensor 232 so that appropriate action can be taken.

Figure 16C:
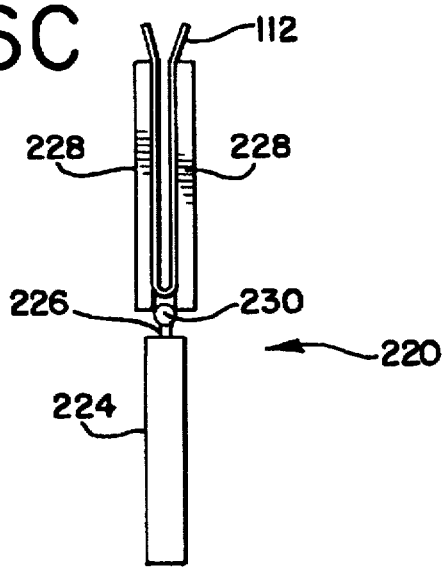

After the piston 226 is retracted as shown in FIG. 15C with a label 112 held in place by the vacuum, rotation about the pivot point 222 begins, while at the same time the vacuum plate 228 folds about the central hinge 230 to fold the label 112 to the orientation shown in FIG. 16C. The rotation of the transfer arm 220 is illustrated in FIGS. 15D and 15E.

After the transfer arm 220 is rotated to the orientation shown in FIG. 15E, and the opposite gripping elements 30 and 32 of the primary gripper are opened, the piston 226 is again extended as shown in FIG. 15F to apply the folded label 112 to the top of the bag 80. When thus in place, the gripping elements 30 and 32 of the primary gripper 18 are closed to sandwich the folded label 112 and the bag 80 therebetween, and vacuum to the vacuum plate 228 is turned off. The piston 226 is then retracted as shown in FIG. 16G, the transfer arm 220 is returned to the home position shown in FIG. 15A, and the process can then be repeated.

As the primary gripper 18 is activated to capture both the bag 80 and the label 112, the secondary gripper comprising the clamp elements 104 and 106 is deactivated, retracting the clamp elements from the bag 80. The primary gripper is then free to be advanced to the sealing and bag release station 16, where the label 112 is sealed to the top of the bag 80 as described above in relation to the first form of the invention.

Various changes can be made to the invention without departing from the spirit thereof or scope of the following claims. As an example only, while various linear actuators have been depicted and described as performing the functions set forth above, obvious other means of shifting elements can be employed, as well. Also, the gripping elements 30 and 32 are depicted in a scissor fashion, but obviously different elements, similar to the clamp elements 104 and 106, could be employed instead. In addition, while, in the second form shown in FIGS. 14–16, the labels are individually stacked in a queue, cut-to-length labels from a queued source, such as a roll of labels, could also be employed. Finally, while an air cylinder is shown in FIG. 16 for pickup of a label, other means, such as a rack and pinion, linear step motor, ball slide or linear screw can be used, as well.

What is claimed:

1. An apparatus for application of a header label to a bag, comprising a. a primary gripper for gripping and transporting a bag, b. means for transferring said primary gripper through a plurality of stations where action is taken on a bag, one of said stations being a label application station, c. a secondary gripper for gripping the bag at said label application station, and means for activating the secondary gripper to grip the bag, d. means for releasing the primary gripper when the bag is gripped by the secondary gripper, e. a supply of individual labels oriented in a queue at said label application station, f. means at said label application station for removing a label from said queue and applying the label to the bag when held by said secondary gripper, g. means for reactivating the primary gripper to grip both the bag and the label, and h. means for deactivating the secondary gripper to release the bag.

2. An apparatus according to claim 1 in which said supply of individual labels is located in a magazine.

3. An apparatus according to claim 2 in which said magazine is oriented with said labels queued in a line lying in a plane generally parallel to a path travelled by said primary gripper, but with said line being at an oblique angle to said path.

4. An apparatus according to claim 1 in which said removing means includes a transfer arm, said transfer arm having a label handling head at one end.

5. An apparatus according to claim 4 in which said label handling head includes means for holding and folding a label.

6. An apparatus according to claim 5 in which said holding and folding means comprises a vacuum plate having a central hinge.

7. An apparatus according to claim 4 in which said transfer arm includes means for linearly translating said label handling head.

8. An apparatus according to claim 7 in which said means for linearly translating comprises an extensible piston.

9. An apparatus according to claim 4 in which said transfer arm is rotatable about a horizontal pivot point.

10. An apparatus according to claim 4 in which said label handling head includes vacuum means for holding a label.

11. An apparatus according to claim 10 including means for sensing vacuum at said label handling head.

12. A method for application of a header label to a bag, comprising the steps of a. orienting a bag vertically at a label application station in the grip of a primary gripper, b. closing a secondary gripper on the bag beneath the primary gripper, c. releasing the primary gripper when the bag is gripped by the secondary gripper, d. selecting a label from a queue of labels located in a line above and in a plane generally parallel to a path travelled by the bag, e. removing the label from the queue and transferring while folding it to a position straddling the top of the bag, f. applying the folded label to the top of the bag, g. reactivating the primary gripper to grip both the bag and the label, and h. deactivating the secondary gripper to release the bag.

13. A method according to claim 12, in which step "a" includes moving the bag via a primary gripper at the top of the bag from an upstream position to the label application station.

14. A method according to claim 13, including in step "c", exposing the top of the bag.

15. A method according to claim 12, in which step "d" includes extending a label handling head to a position adjacent the label, and activating a vacuum plate in said label handling head to select the label.

16. A method according to claim 15, including the further step of sensing vacuum in the plate, and generating a signal if a predetermined level of vacuum is not sensed.

17. A method according to claim 12, in which step "e" includes rotating the label in an arc, and simultaneously folding the label as it is rotated.

18. A method according to claim 12, including transferring the bag and the label from the label application station to a label sealing station, and heat sealing the label to the bag.

* * * * *